US007172271B2

(12) United States Patent
Tominaga et al.

(10) Patent No.: US 7,172,271 B2
(45) Date of Patent: Feb. 6, 2007

(54) INK-JET PRINT HEAD AND INK-JET RECORDING APPARATUS

(75) Inventors: Kazuyoshi Tominaga, Chiba (JP); Osamu Koseki, Chiba (JP); Masaki Denda, Chiba (JP); Tomiharu Makishima, Chiba (JP); Yasuhito Sekiya, Chiba (JP); Jun Tsuneyoshi, Chiba (JP); Yuuji Nakamura, Chiba (JP); Kentarou Suzuki, Chiba (JP)

(73) Assignee: SII Printek Inc., Chiba (JP)

( * ) Notice: Subject to any disclaimer, the term of this patent is extended or adjusted under 35 U.S.C. 154(b) by 288 days.

(21) Appl. No.: 10/397,863

(22) Filed: Mar. 26, 2003

(65) Prior Publication Data

US 2004/0017439 A1 Jan. 29, 2004

(30) Foreign Application Priority Data

Apr. 19, 2002 (JP) ..... 2002-117918

(51) Int. Cl.
*B41J 2/045* (2006.01)

(52) U.S. Cl. ..... 347/68

(58) Field of Classification Search ..... 347/65, 347/85–87, 68–72

See application file for complete search history.

(56) References Cited

U.S. PATENT DOCUMENTS 5,708,465 A * 1/1998 Morita et al. ..... 347/65
6,039,437 A * 3/2000 Tsujimoto ..... 347/63
6,409,316 B1 * 6/2002 Clark et al. ..... 347/63

* cited by examiner

*Primary Examiner*—An H. Do
(74) *Attorney, Agent, or Firm*—Adams & Wilks

(57) ABSTRACT

An ink-jet print head has a piezoelectric ceramic plate having grooves for receiving ink, a nozzle plate connected to the piezoelectric ceramic plate and having nozzle apertures each disposed in communication with respective ones of the grooves, and an ink storing device for storing ink. An ink chamber plate is connected to the piezoelectric ceramic plate and has an ink chamber for supplying ink from the ink storing device to the grooves. A base plate is connected to a side of the ink chamber plate and has an ink reservoir defining a portion of an ink flow path for transporting ink from the ink storing device to the ink chamber of the ink chamber plate. The ink reservoir has at least one tapered portion progressively diverging in a direction toward the ink chamber of the ink chamber plate.

21 Claims, 14 Drawing Sheets

INK-JET PRINT HEAD AND INK-JET RECORDING APPARATUS

BACKGROUND OF THE INVENTION

1. Field of the Invention

The present invention relates to an ink-jet print head and an ink-jet recording apparatus adapted for printing by ejecting an ink droplet from a nozzle aperture, and more particularly, to an ink-jet print head and ink-jet recording apparatus which employ an ink, such as an aqueous ink, which is prone to form bubbles hard to penetrate.

2. Description of the Related Art

Conventionally, ink-jet recording apparatuses have been known which are adapted to record characters or images on a receiving medium by means of an ink-jet print head having a plurality of nozzles for ink ejection. In such ink-jet recording apparatuses, the ink-jet print head is assembled with a head holder as directing its nozzles toward the receiving medium, whereas the head holder is mounted to a carriage to scan along a direction orthogonal to a direction in which the receiving medium is conveyed.

One example of such an ink-jet print head is shown in an exploded perspective view of FIG. 14. As seen in FIG. 14, a piezoelectric ceramic plate 121 is formed with a plurality of grooves 122 extended in parallel with one another and separated from one another by sidewalls 123. Each of the grooves 122 has one longitudinal end thereof extended to one end face of the piezoelectric ceramic plate 121. The other longitudinal end of each groove is not extended to the other end face of the piezoelectric ceramic and, therefore, the groove is progressively decreased in depth toward the other end thereof. In each groove 122, the opposite side walls 123 are formed with electrodes 124 for drive voltage application on their surface portions on an open side, the electrode extending along the longitudinal length of the side wall.

An ink chamber plate 126 is bonded to the piezoelectric ceramic plate 121 on the open side of the grooves 122, defining a common ink chamber 125 communicated with the shallowed ends of the grooves 122.

Fixed on the ink chamber plate 126 is a flow-path base plate 128 which seals one side of the common ink chamber 125 and has a communication hole 127 communicated with an ink supply path for supplying ink to the common ink chamber 125.

The flow-path base plate is provided with an ink reservoir 129 for supplying the ink to the common ink chamber 125.

A nozzle plate 130 is bonded to an end face of a unified body of the piezoelectric ceramic plate 121 and the ink chamber plate 126, into which face the grooves 122 open. The nozzle plate 130 is formed with nozzle apertures 131 in correspondence with the grooves 122.

In the ink-jet print head thus arranged, the ink is filled in the grooves 122 via the communication hole 127. When a predetermined driving electric field is applied to the side walls 123 on the opposite sides of a given groove 122 via the electrodes 124, the side walls 123 are transformed so that the volume of the given groove 122 is varied. This causes the ink in the groove 122 to be ejected through the nozzle aperture 131.

Such an ink-jet print head has a problem of ink jet failure which, for example, is caused by foreign substances contained in the ink. In this connection, a mesh filter 132 is disposed in the communication hole 127 at an end thereof adjoining the common ink chamber 125 in order to prevent the foreign substances and the like contained in the ink from entering the common ink chamber 125. Such a filter 132 also serves to apply a back pressure to the grooves 122.

Unfortunately, the ink reservoir of the conventional ink-jet print head includes a region where the ink flow tends to stagnate. For instance, the ink flow introduced into the ink reservoir becomes stagnant at a corner portion thereof or the like, where air bubbles accumulate. The accumulation of the air bubbles in such a region reduces the ink volume in the ink reservoir so that a shortage of ink supply to the ink chamber results. Particularly when the ink, such as an aqueous ink, which is prone to form bubbles of low penetration is used, the dwell of the air bubbles is pronounced.

Such air bubbles remaining in the ink reservoir are generally removed by sucking from the nozzle apertures or by performing a so-called cleaning operation. Unfortunately, the cleaning operation cannot fully remove the air bubbles from the region where the ink flow stagnates.

Thus, the ink-jet print head incapable of removing the air bubbles from the region suffering the ink flow stagnation is discarded because the remaining air bubbles are allowed to pass the filter during printing operations to be ejected along with the ink droplets so that a print failure results. As a result, the yield is decreased.

Furthermore, in a case where the ink droplets have large sizes or a large number of nozzle apertures are provided or where a large quantity of ink is ejected per unit time, the amount of air bubbles remaining in the ink reservoir is particularly increased so that the area of the ink flow path is substantially decreased. Accordingly, the shortage of ink supply to the ink chamber becomes more and more serious.

It may be contemplated to increase the flow rate of the ink by narrowing the flow path in the ink reservoir thereby purging the air bubbles from the ink reservoir. However, the size of the filter is substantially decreased, resulting in the shortage of ink supply to the common ink chamber.

SUMMARY OF THE INVENTION

In view of the foregoing, it is an object of the invention to provide an ink-jet print head and ink-jet recording apparatus which are adapted to prevent the dwell of the air bubbles contained in the ink and to purge the air bubbles relatively easily.

A first embodiment of the invention for achieving the above object is implemented in an ink-jet print head comprising a plurality of grooves communicated with nozzle apertures, an ink chamber for supplying ink to the individual grooves, and an ink reservoir defining a communication portion of a flow path with the ink chamber. The flow path intercommunicates ink storage means for storing the ink and the ink chamber. The ink reservoir includes a tapered portion opened progressively wider toward the ink chamber.

A second embodiment of the invention as defined by the first embodiment thereof is implemented in an ink-jet print head wherein the ink reservoir comprises a filter disposed near its boundary with the ink chamber.

A third embodiment of the invention as defined by the first embodiment thereof is implemented in an ink-jet print head wherein the ink reservoir comprises a filter disposed intermediate the tapered portion.

A fourth embodiment of the invention as defined by any one of the first to third embodiments thereof is implemented in an ink-jet print head wherein the ink reservoir includes a communication hole defining a communication portion with a flow path intercommunicating the ink storage means and the ink reservoir, and wherein the tapered portion is opened progressively wider from the communication hole toward the ink chamber.

A fifth embodiment of the invention as defined by the first or second embodiment thereof is implemented in an ink-jet print head wherein the ink reservoir includes a plurality of communication holes defining communication portions with a flow path intercommunicating the ink storage means and the ink reservoir, and wherein, the tapered portions are opened progressively wider from the plural communication holes toward the ink chamber.

A sixth embodiment of the invention as defined by any one of the first to fifth embodiments thereof is implemented in an ink-jet print head wherein a direction of an in-flow of the ink from the communication hole into the ink reservoir is substantially orthogonal to a direction of an out-flow of the ink from the ink reservoir toward the ink chamber.

A seventh embodiment of the invention as defined by the sixth embodiment thereof is implemented in an ink-jet print head wherein the in-flow of the ink from the communication hole is directed vertically downward and wherein a throttling portion narrowing the flow path is provided vertically downwardly of a boundary between the ink reservoir and the ink chamber.

An eighth embodiment of the invention as defined by the seventh embodiment thereof is implemented in an ink-jet print head wherein the throttling portion has a tapered configuration progressively narrowing the flow path toward the ink chamber.

A ninth embodiment of the invention is implemented in an ink-jet print head comprising a plurality of grooves communicated with nozzle apertures; an ink chamber for supplying ink to the individual grooves; and an ink reservoir defining a communication portion of a flow path with the ink chamber, the flow path inter communicating ink storage means for storing the ink and the ink chamber, the ink-jet print head wherein the ink reservoir includes a throttling portion narrowing the flow path toward the ink chamber.

A tenth embodiment of the invention as defined by the ninth embodiment thereof is implemented in an ink-jet print head wherein the throttling portion has a tapered configuration progressively narrowing the flow path toward the ink chamber.

An eleventh embodiment of the invention as defined by the ninth or tenth embodiment thereof is implemented in an ink-jet print head wherein the ink reservoir comprises a filter disposed near its boundary with the ink chamber.

A twelfth embodiment of the invention as defined by any one of the ninth to eleventh embodiments thereof is implemented in an ink-jet print head wherein the ink reservoir includes a communication hole defining a communication portion with a flow path intercommunicating the ink storage means and the ink reservoir, and wherein the throttling portion progressively narrowing the flow path from the communication hole toward the ink chamber.

A thirteenth embodiment of the invention as defined by any one of the ninth to eleventh embodiments thereof is implemented in an ink-jet print head wherein the ink reservoir includes a plurality of communication holes defining communication portions with a flow path intercommunicating the ink storage means and the ink reservoir and wherein the throttling portion progressively narrows the flow path from the plural communication holes toward the ink chamber.

A fourteenth embodiment of the invention as defined by any one of the ninth to thirteenth embodiments thereof is implemented in an ink-jet print head wherein a direction of an in-flow of the ink from the communication hole into the ink reservoir is substantially orthogonal to a direction of an out-flow of the ink from the ink reservoir toward the ink chamber.

A fifteenth embodiment of the invention is implemented in an ink-jet recording apparatus comprising the ink-jet print head as defined by any one of the first to fourteenth embodiments thereof.

According to the invention, at least one of the tapered portion opened progressively wider toward the ink chamber and the throttling portion narrowing the flow path toward the ink chamber is provided in the ink reservoir whereby the air bubbles contained in the ink are prevented from remaining in the ink reservoir so as to eliminate the shortage of ink supply. Furthermore, the invention permits the air bubbles to be relatively easily removed from the nozzle apertures.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

The invention will hereinbelow be described in detail with reference to the embodiments thereof.

First Embodiment

Figure 1:
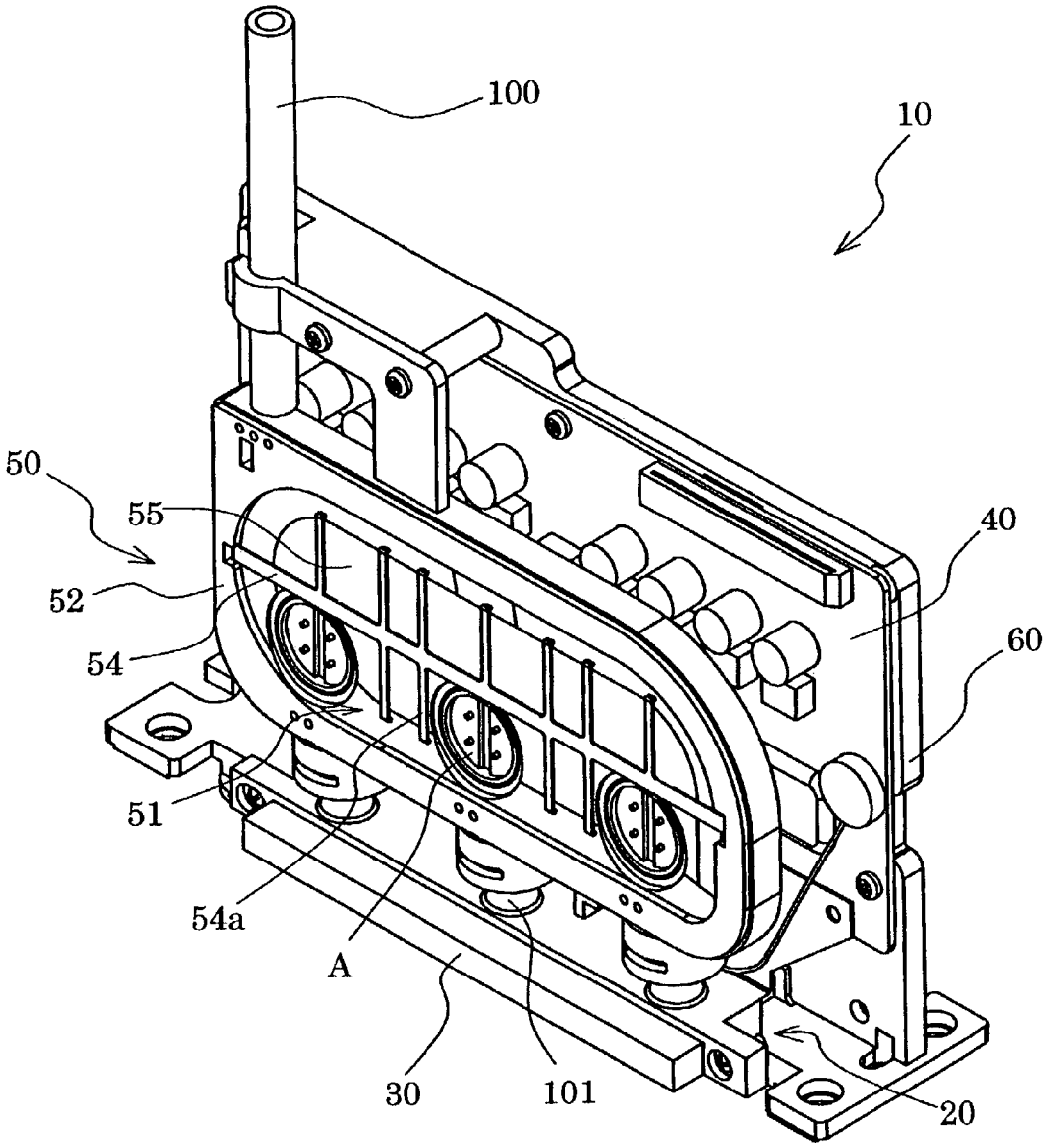
FIG. 1 is a perspective view showing an ink-jet print head according to a first embodiment of the invention.
Figure 2A:
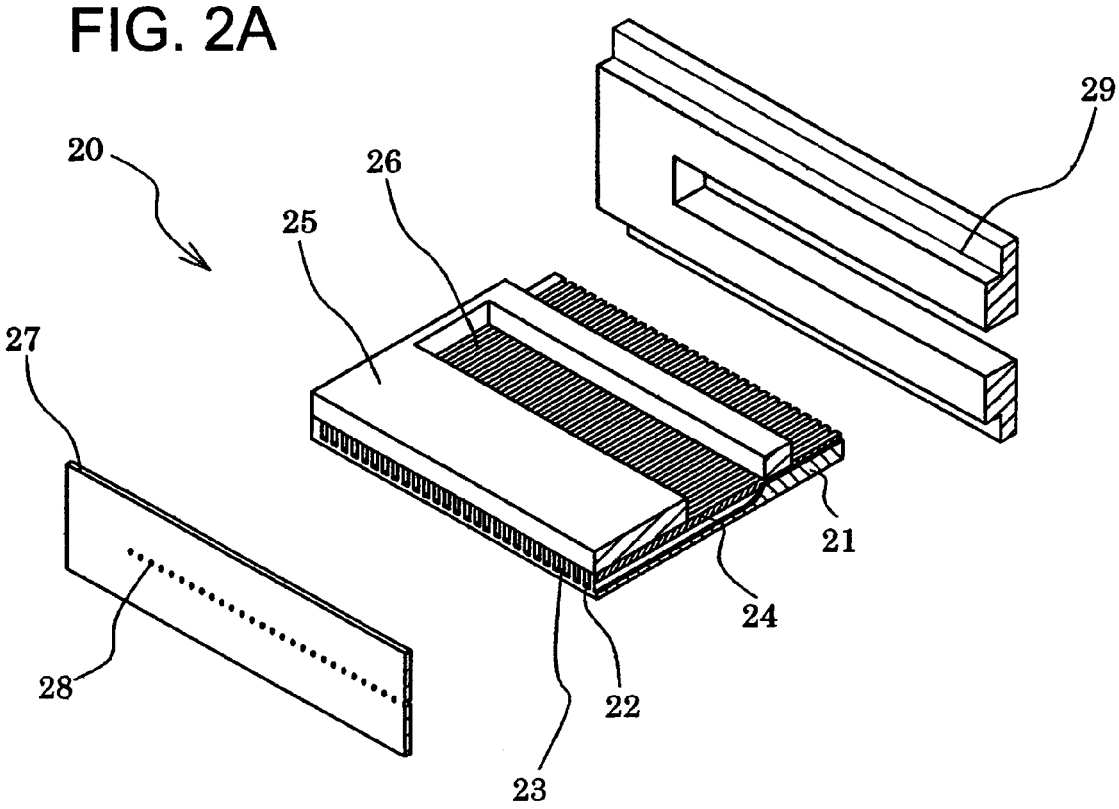
FIGS. 2A and 2B are an exploded perspective view and a perspective sectional view, respectively, showing a head chip according to the first embodiment of the invention.
Figure 2B:
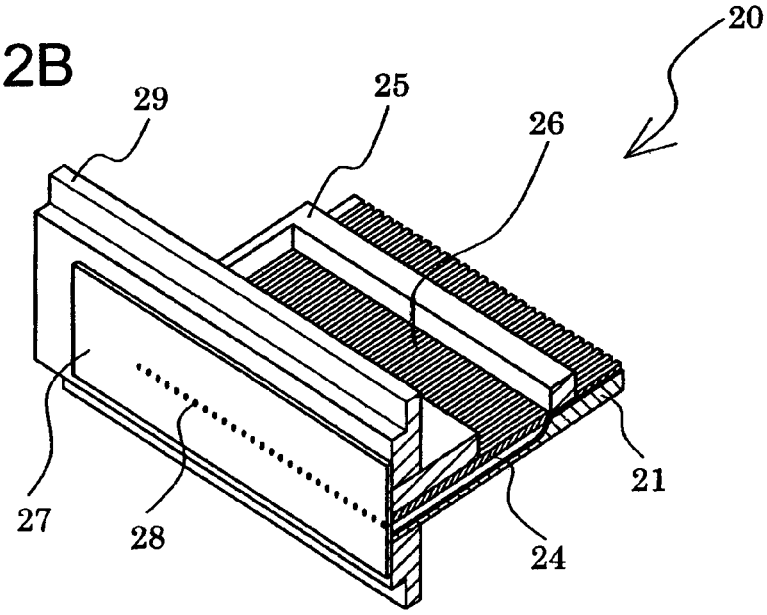
Figure 3:
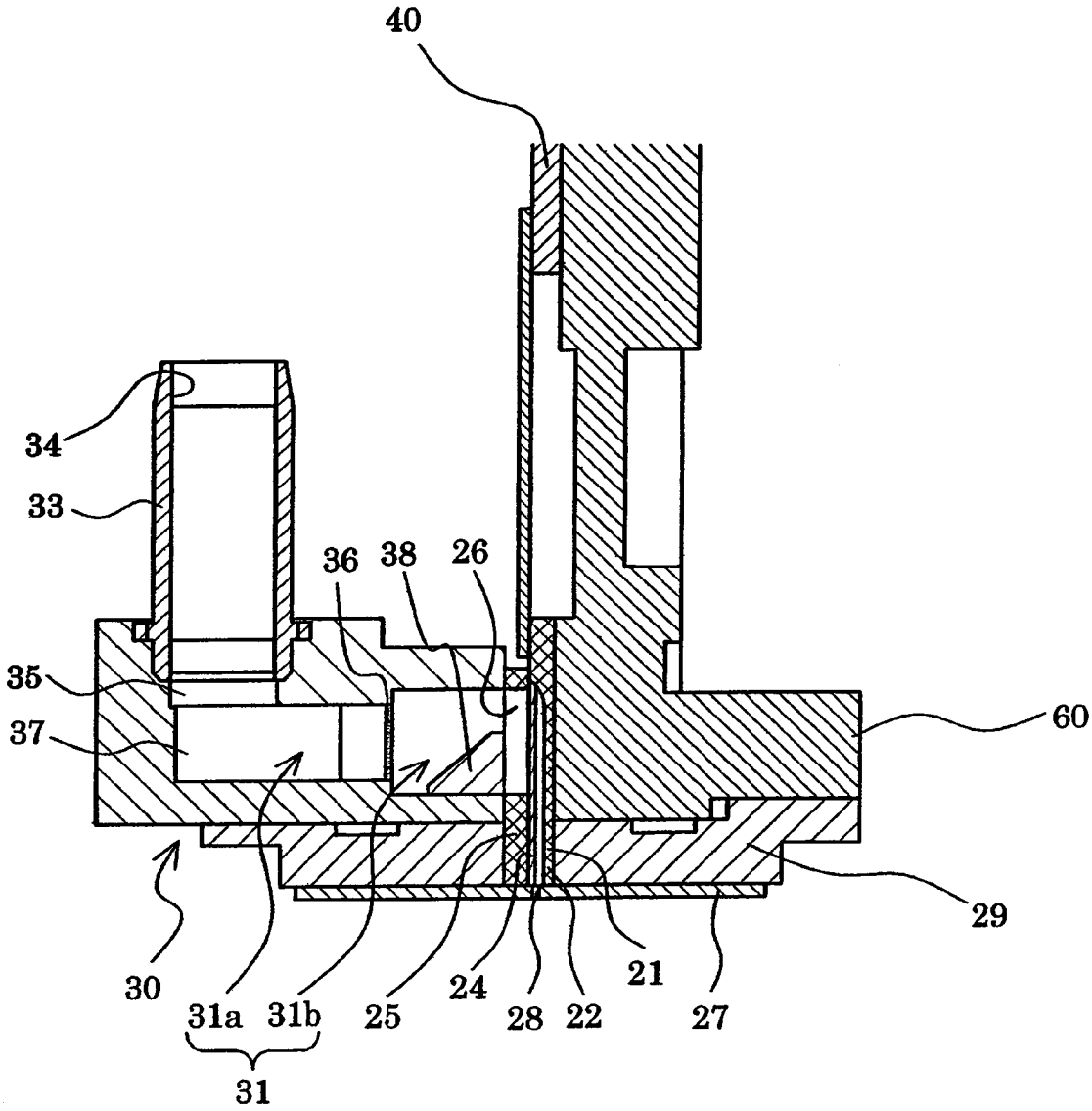
FIG. 3 is a sectional view showing a principal part of the ink-jet print head according to the first embodiment of the invention.

FIG. 1 is a perspective view showing an ink-jet print head according to a first embodiment. FIGS. 2A–2B are an exploded perspective view and a perspective sectional view, respectively, showing a head chip. FIG. 3 is a sectional view showing a principal part of the ink-jet print head.

As shown in the figures, an ink-jet print head 10 according to the embodiment includes a head chip 20, a flow-path base plate 30 disposed on one side of the head chip, a wiring board 40 having a drive circuit for driving the head chip 20 and others mounted thereon, and an air damper 50 for reducing pressure variations in the head chip 20, these components being secured to a base plate 60.

A piezoelectric ceramic plate 21 constituting the head chip 20 is formed with a plurality of grooves 22 extended in parallel relation and communicated with nozzle apertures. The individual grooves 22 are separated from one another by side walls 23. Each of the grooves 22 has one longitudinal end thereof extended to one end face of the piezoelectric ceramic plate 21 and the other end portion terminated short of the other end face of the piezoelectric ceramic plate. Thus, each groove is progressively decreased in depth toward the other end thereof. The side walls 23 on the laterally opposite sides of each groove 22 are each formed with an electrode 24 for drive voltage application and which is longitudinally extended to the aperture side of groove 22.

The grooves 22 defined in the piezoelectric ceramic plate 21 are formed by means of, for example, a disc-like dies cutter. A shape of the groove portion progressively decreased in depth depends upon a shape of the dies cutter. The electrode 24 provided in each groove 22 is formed by the known angled evaporation process, for example.

An ink chamber plate 25 is bonded to the piezoelectric ceramic plate 21 on an open side of the grooves 22. The ink chamber plate 25 is formed with a common ink chamber 26 which is formed by partially cutting off the ink chamber plate and extends over all the grooves 22 in juxtaposition.

Although the ink chamber plate 25 may be formed of a ceramic plate, a metal plate or the like, the ceramic plate having a thermal expansion coefficient close to that of the piezoelectric ceramic plate may preferably be employed in light of its deformation after being bonded to the piezoelectric ceramic plate 21.

A nozzle plate 27 is bonded to an end face of a unified body of the piezoelectric ceramic plate 21 and ink chamber plate 25, into which face the grooves 22 open. The nozzle plate 27 is formed with nozzle apertures 28 at places opposite the respective grooves 22.

According to this embodiment, the nozzle plate 27 has a greater area than that of the end face of the unified body of the piezoelectric ceramic plate 21 and ink chamber plate 25, into which face the grooves 22 open. The nozzle plate 27 is formed of a polyimide film or the like, in which the nozzle apertures 28 are formed using, for example, an excimer laser apparatus. In addition, a water repellent film (not shown) having water repellence for preventing ink adhesion is applied to a surface of the nozzle plate 27 that opposes a material to be printed.

According to the embodiment, a nozzle support plate 29 extends around the end face of the unified body of the piezoelectric ceramic plate 21 and ink chamber plate 25, into which face the grooves 22 open. The nozzle support plate 29 has one surface thereof bonded to the nozzle plate 27 and the other surface thereof bonded to the unified body of the piezoelectric ceramic plate 21 and ink chamber plate 25.

The flow-path base plate 30 is bonded to one side of the ink chamber plate 25 via an O-ring or the like, for example, so that one side of the common ink chamber 26 is sealed by the flow-path base plate 30.

Figure 4A:
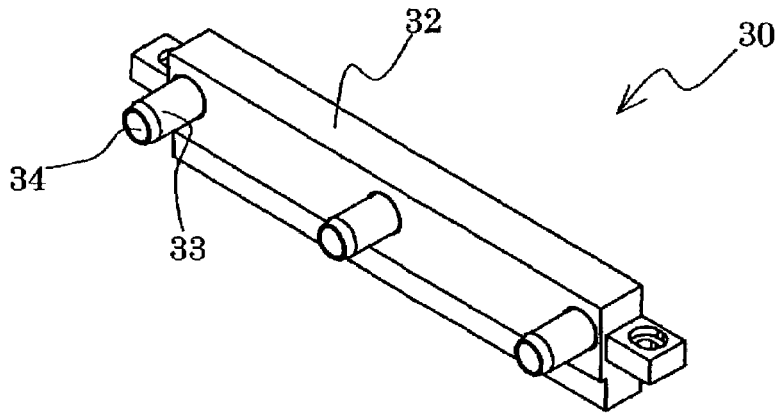
FIG. 4 is a group of schematic diagrams showing a flow-path base plate according to the first embodiment of the invention, with FIG. 4A representing a perspective view and FIG. 4B representing a plan view.
Figure 4B:
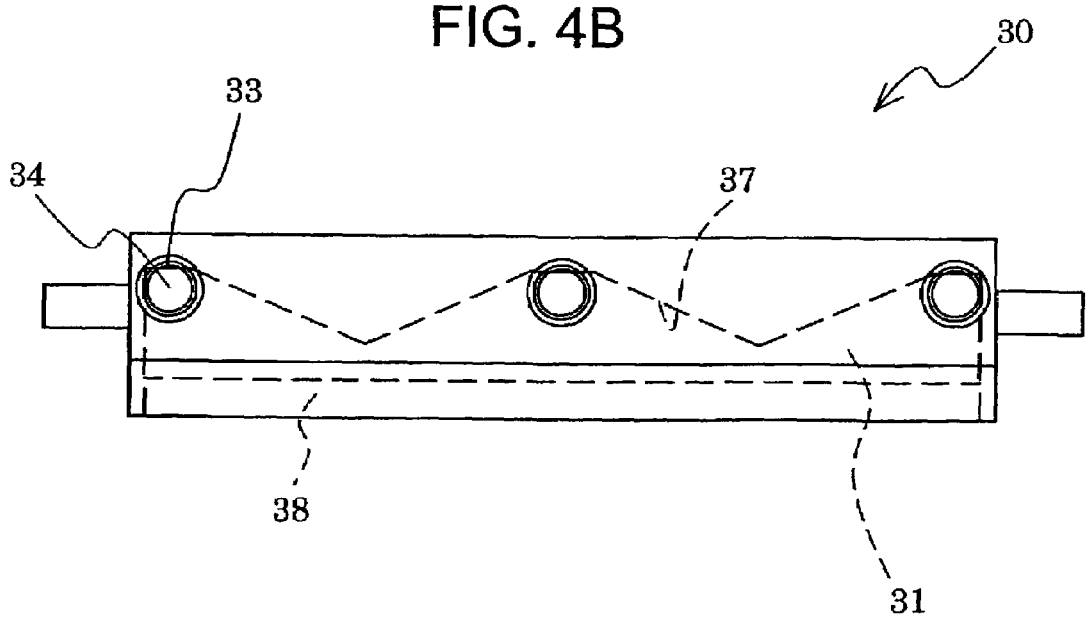

Here, the flow-path base plate is specifically described with reference to FIGS. 3 and 4 FIGS. 4A–4B are schematic diagrams showing the flow-path base plate according to the first embodiment of the invention, with FIG. 4A representing a perspective view and FIG. 4B representing a plan view.

As shown in FIGS. 3 and 4, the flow-path base plate 30 includes a flow path body 32 having an ink reservoir 31, air dampers 50 (to be described hereinlater) disposed on longitudinally opposite ends and substantially at an intermediate place of the flow path body, and cylindrical communication portions 33 which each communicate with the common ink chamber 26 and define a part of a flow path. Each of the communication portions 33 is formed with an ink supply path 34 axially extended therethrough.

The ink reservoir 31 is defined between the ink supply paths 34 and the common ink chamber 26 of the ink chamber plate 25. That is, the ink reservoir 31 constitutes a part of a flow path that receives ink from the individual ink supply paths 34 and delivers the supplied ink to the common ink chamber 26.

The ink reservoir 31 is provided with communication holes 35 which each communicate with the respective ink supply path 34.

Disposed in the ink reservoir 31 is a filter 36 for removing, for example, foreign substances contained in the ink. Thus, the embodiment is arranged such that the ink reservoir 31 is partitioned by the filter 36 thereby defining a first ink pool portion 31*a* on the communication holes 35 side and a second ink pool portion 31*b* on the common ink chamber 26 side.

The first ink pool portion 31*a* is provided with a tapered portion 37 progressively diverging or expanding the ink flow path from each communication hole 35 toward the common ink chamber 26. According to the embodiment, the individual tapered portions 37 are extended from the respective communication holes 35 to be terminated short of the filter 36 and join together at place upstream from the filter 36.

On the other hand, the second ink pool portion 31*b* is provided with a throttling portion 38 vertically downwardly of its boundary with the common ink chamber 26, the throttling portion narrowing the flow path for the ink through the filter 36. The throttling portion 38 has a tapered configuration progressively narrowing the ink flow path from the filter 36 toward the common ink chamber 26.

In the ink reservoir 31 according to the embodiment, a direction of an in-flow of the ink from the communication holes 35 into the first ink pool portions 31*a* is substantially orthogonal to a direction of an out-flow of the ink from the second ink pool portions 31*b* toward the common ink chamber 26. Specifically, the flow path is formed such that the ink supplied from the air damper 50 flows vertically downwardly into the first ink pool portions 31*a* via the communication holes 35 and then after passage through the filter 36, the ink flows along the tapered structure of the throttling portion 38 or along the direction substantially orthogonal to the in-flow of the ink into the first ink pool portions 31*a* to enter the common ink chamber 26.

Within the ink reservoir 31, the first ink pool portion 31*a* is provided with the tapered portion 37 thereby eliminating a region of the ink flow stagnation from the first ink pool portion 31*a*. That is, the ink supplied from the air damper 50 is allowed to reach every corner of the first ink pool portion 31*a*.

The tapered portion 37 progressively expands the flow path toward the filter 36 so that the ink can be assuredly delivered even to the region of the ink flow stagnation in the first ink pool portion 31*a*.

In addition, the region of the ink flow stagnation can be eliminated from the second ink pool portion 31*b* by providing the second ink pool portion 31*b* with the throttling portion 38 which narrows the ink flow path between the filter 36 and the common ink chamber 26 thereby increasing the flow rate of the ink. Thus, the portion provided with the throttling portion 38 is a corner of the second ink pool portion 31*b* that is the farthest from an in-flow side and hence, the ink flow tends to stagnate at this corner. According to the embodiment, the throttling portion 38 is provided at the corner with the ink flow stagnation, forming the tapered structure which permits the ink through the filter 36 to flow into the common ink chamber 26 smoothly on the other hand, the ink flow is converged to a region closest to the out-flow side where the ink flows at a higher rate and which is located vertically upwardly. Therefore, the air bubbles accumulate at this region and hence, can be removed easily.

In this manner, the embodiment prevents the air bubbles contained in the ink from remaining in the ink reservoir 31. The air bubbles may be fully removed by drawing out the ink from the nozzle apertures 28 when an initial ink charging or a cleaning operation is performed.

According to the embodiment, the tapered portions 37 and throttling portion 38 provided in the ink reservoir 31 permit the ink supplied to the ink reservoir 31 to be smoothly delivered from the communication holes 35 to the common ink chamber 26. Hence, the ink reservoir 31 is eliminated of the region of the ink flow stagnation so that the air bubbles contained in the ink are effectively prevented from remaining in the ink reservoir 31. When applied to the ink-jet print head using an aqueous ink composition having a poor penetration, the embodiment presents a particularly excellent effect.

According to the embodiment, the provision of the throttling portion 38 in the second ink pool portion 31*b* permits the use of the filter 36 of a desired size and also increases the flow rate of the ink through the ink reservoir 31. Therefore, the shortage of ink supply can be avoided.

Figure 5:
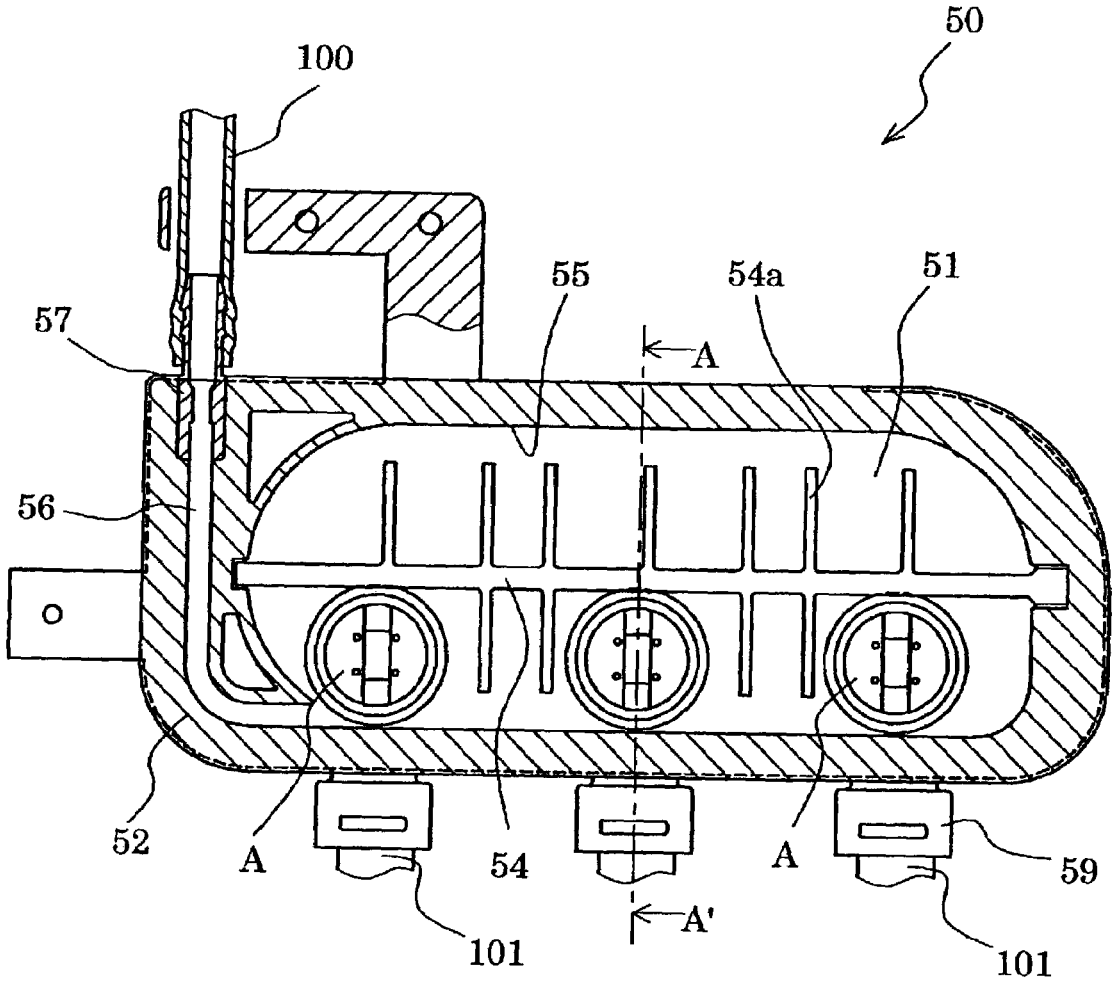
FIG. 5 is a sectional view showing an air damper according to the first embodiment of the invention as viewed from a surface thereof.
Figure 6:
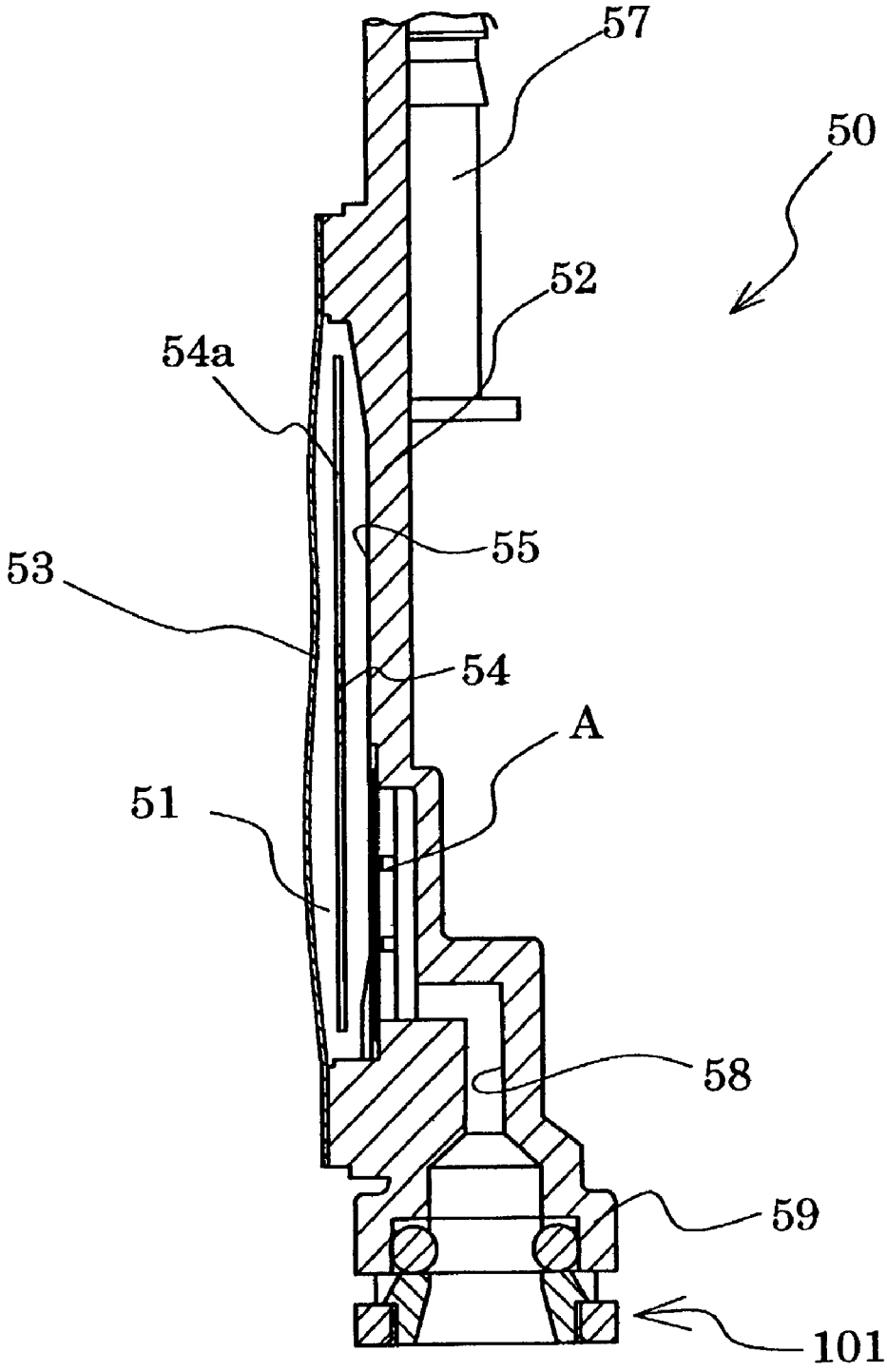
FIG. 6 is a sectional view taken on the line A–A' in FIG. 5 according to the first embodiment of the invention.

Now referring to FIGS. 5 and 6, the aforesaid air damper 50 for supplying the ink to the ink reservoir 31 of the flow-path base plate 30 is described. FIG. 5 is a sectional view of the air damper according to the first embodiment of the invention as viewed from a surface of the air damper. FIG. 6 is a sectional view taken on the line A–A' in FIG. 5.

As shown in the figures, the air damper 50 comprises a damper body 52 having an ink storage portion 51 for storing the ink, a film-like member 53 for sealing the ink storage portion 51 as attached to an end surface of the damper body 52 on a side with respect to a direction orthogonal to a scanning direction of the ink-jet print head 10, and a damper plate 54 retained in the ink storage portion 51 and having a shape of a thin plate.

The damper body 52 is formed with a recess 55 on an opposite side from the base plate 60. The ink storage portion 51 is defined by sealing an opening of the recess 55 with the film-like member 53.

Furthermore, the damper body 52 is provided with a charge path 56 for charging the ink in the ink storage portion 51. The charge path 56 is connected with an ink supply tube 100 via a joint member 57, the ink supply tube comprising a flexible tube, such as formed of rubber, plastic or the like, and connected with an ink tank (not shown).

According to the embodiment, the damper body 52 is further provided with supply tubes 59 which are connected to the respective communication portions 33 of the aforesaid flow-path base plate 30 via respective ink communication tubes 101 and which are each provided with a supply path 58 for supplying the ink from the ink storage portion 51.

In addition, a filter A is disposed at a boundary between the ink storage portion 51 and the supply path 58 for removing fine foreign substances and the like. The ink is supplied to each communication portion 33 of the flow-path base plate 30 via each ink communication tube 101 connected with the other end of the supply path 58.

The film-like members 53 for sealing the ink storage portion 51 are bonded to the damper body 52 on laterally opposite surfaces thereof.

Examples of a usable material for the film-like member 53 include thin film members adapted for elastic deformation such as ester resins like polyethylene terephthalate (PET), nylon resins and the like. The material for and the thickness of the film-like member 53 may suitably be decided according to the viscosity of an ink used with the ink-jet print head 10, the degree of acceleration or deceleration of the ink-jet print head 10 with respect to the scanning direction, or a uniform speed of the print head. The embodiment employs a film-like member 70 formed of a PET film having a thickness of 30 μm.

The film-like member 53 is bonded to an edge of the opening of the ink storage portion 51 of the damper body 52 in intimate contact therewith so that gas or the ink in the storage portion 51 may not leak therefrom. Although a method for bonding the film-like member 53 to the damper body 52 is not particularly limited, the embodiment adopts a heat fusion method.

Disposed in such an ink storage portion 51 is the damper plate 54 comprising a plate-like member such as formed of stainless steel or the like. The damper plate 54 is retained by the damper body 52 in a manner to define a predetermined clearance between itself and a depressed wall of the recess 55.

The damper plate 54 further includes a plurality of projections 54*a* projecting vertically upward and downward as seen in the figures such that the damper plate may present a wide area to the film-like member 53. Thus, the film-like member 53 is prevented from coming into contact with the depressed wall of the recess 55, thereby ensuring that the amount of ink charged in the ink storage portion 51 is maintained at a constant level.

An arrangement is made such that the ink is supplied from the ink tank via the ink supply tube 100, the joint member 57 and the charge path 56 in this order so as to charge the ink storage portion 51 with the ink.

The aforementioned air damper 50 serves to regulate the pressure of the ink in the common ink chamber 26 and grooves 22 of the head chip 20. Specifically, when the ink-jet print head 10 is moved along a primary scanning direction, the pressure in the head chip 20 is varied so that meniscuses formed in the nozzle apertures 28 due to the surface tension of the ink may be destroyed. Hence, the air damper 50 is used to regulate the pressure variations in the head chip 20 for maintaining stable meniscuses for ink ejection.

Furthermore, the air damper 50 accommodates therein a predetermined amount of ink and gas, such as air, thereby serving to hold the air bubbles for preventing the air bubbles contained in the ink supply tube 100 from entering the common ink chamber 26.

Here, description is made on a serial-type ink-jet recording apparatus having the aforementioned ink-jet print head mounted thereto.

Figure 7:
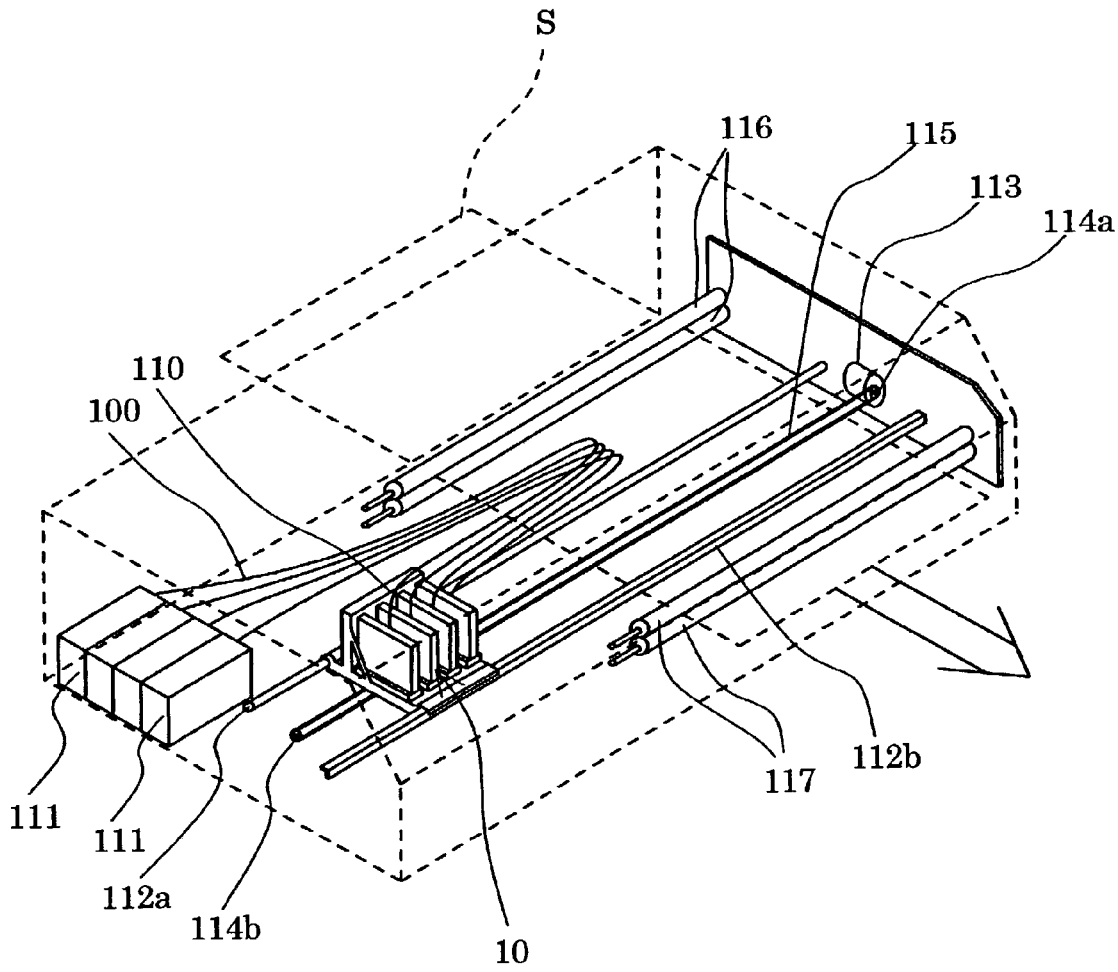
FIG. 7 is a schematic perspective view showing an ink-jet recording apparatus according to the first embodiment of the invention.

As shown in FIG. 7, the ink-jet recording apparatus comprises a plurality of ink-jet print heads 10 provided for individual different colors, a carriage 110 on which the plural ink-jet print heads 10 are arranged in parallel relation and along the scanning direction, and ink cartridges 111 for supplying inks to the print heads via the ink supply tubes 100 formed of a flexible tube. The carriage 110 is axially movably mounted on a pair of guide rails 112*a*, 112*b*. A drive motor 113 is disposed at one end of the guide rails 112*a*, 112*b*. A driving force of the drive motor 113 causes the carriage 110 to move along a timing belt 115 entrained between a pulley 114*a* coupled with the drive motor 113 and a pulley 114*b* disposed at the other end of the guide rails 112*a*, 112*b*.

A respective pair of conveyance rollers 116, 117 are disposed on opposite ends with respect to a direction orthogonal to a direction of conveying the carriage 110 and are extended in parallel with the guide rails 112*a*, 112*b*. The conveyance rollers 116, 117 serve to advance a receiving medium S under the carriage 110 and along a direction orthogonal to the direction of conveying the carriage 110.

While the conveyance rollers 116, 117 advance the receiving medium S, the carriage 110 is scanned over the receiving medium orthogonally to the direction of advancing the receiving medium S whereby the ink-jet print heads 10 are allowed to print characters, images and the like on the receiving medium S.

The ink pressures in the head chips 20 of the ink-jet print heads 10 are varied by the movement of the carriage 110. However, the air dampers 60 provided in the ink-jet print heads 10 regulate the pressures easily so that the inks may preferably be ejected.

It is noted that the ink-jet print head 10 according to the embodiment is adapted to eject an ink of a single color. Thus, the embodiment is arranged such that four ink-jet print heads corresponding to Black (B), Yellow (Y), Magenta (M) and Cyan (C) are mounted on the carriage 110 in juxtaposition.

On the other hand, there are provided four ink cartridges 111 in correspondence to the respective ink-jet print heads 10 of the individual colors. The ink cartridges 111 are located at such a place as not to interfere with the movement of the carriage 110 along the primary scanning direction or with the movement of the receiving medium S and at a position a given amount lower than the nozzle apertures of the ink-jet print heads in order to apply a negative pressure to the interiors of the ink-jet print heads.

It is noted that the aforementioned ink-jet recording apparatus is provided with suction means (not shown) which is used for a so-called cleaning operation where in the ink is sucked from the nozzle apertures 28. The suction means sucks from the nozzle apertures 28 the ink in the common ink chamber 26 and grooves 22 at a given timing, thereby assuredly removing the air bubbles contained in the ink in the common ink chamber 26 and grooves 22. This ensures a favorable printing quality at all times.

Although the embodiment has been described by way of the example of the ink-jet recording apparatus wherein the ink cartridges 111 of four colors are mounted, the invention is not limited to this. The invention may also include ink-jet recording apparatuses wherein the ink cartridges of 5 to 8 colors are mounted.

Second Embodiment

Figure 8A:
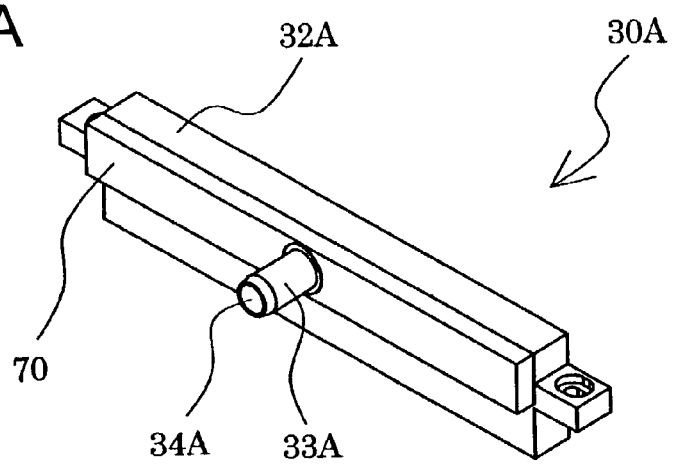
FIG. 8 is a group of schematic diagrams showing a flow-path base plate according to a second embodiment of the invention, with FIG. 8A representing a perspective view, FIG. 8B representing a plan view and FIG. 8C representing a sectional view taken on the line B–B' in FIG. 8B.
Figure 8B:
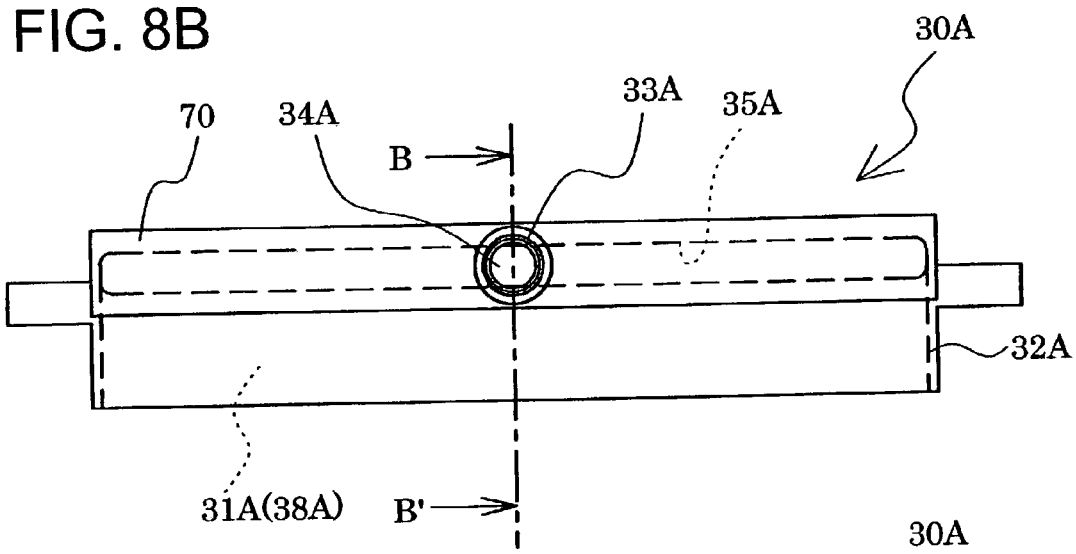
Figure 8C:
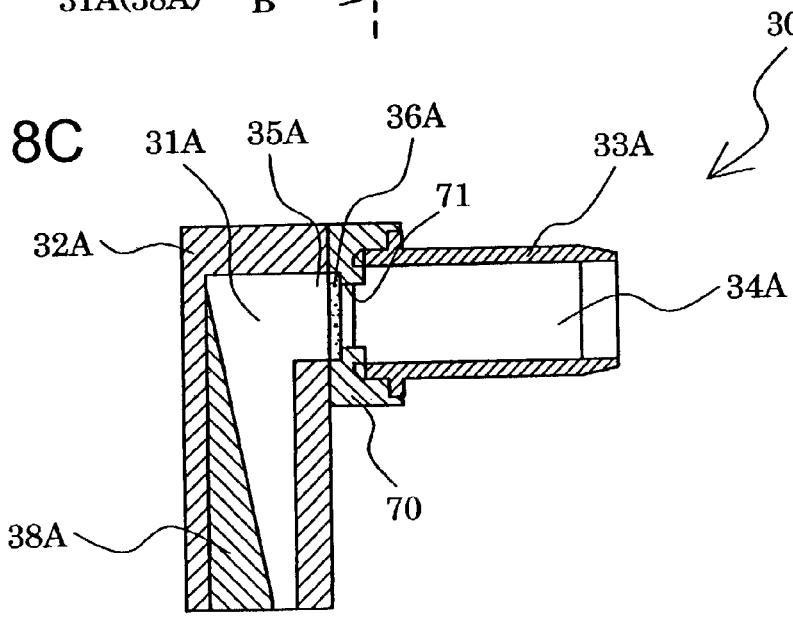

FIG. 8 is a group of schematic diagrams showing a flow-path base plate according to a second embodiment of the invention, with FIG. 8A representing a perspective view thereof, FIG. 8B representing a plan view thereof and FIG. 8C representing a sectional view taken on the line B–B' in FIG. 8B.

As shown in the figures, a flow-path base plate 30A according to the embodiment comprises a flow path body 32A having an ink reservoir 31A, a sealing base plate 70 for sealing the ink reservoir 31A of the flow path body 32A, and a communication portion 33A joined to the sealing base plate 70 substantially at a central portion thereof and having an ink supply path 34A for supplying the ink to the ink reservoir 31A.

The flow path body 32A is provided with a communication hole 35A of a great width which is extended between longitudinally opposite ends of the flow path body and communicated with the ink reservoir.

The sealing base plate 70 includes a through hole 71 communicated with a substantially central portion of the communication hole 35A and is provided with a filter 36A resemblent to that of the aforementioned first embodiment at its boundary with the ink reservoir 31A. It is noted that the sealing base plate 70 is bonded to the flow path body as having its openings sealed except for the hole communicated with the communication hole 35A of the flow path body 32A.

The ink reservoir 31A is provided with a throttling portion 38A progressively narrowing the ink flow path extended from the communication hole 35A to the common ink chamber.

Within such an ink reservoir 31A, an ink flow path is formed such that an in-flow of the ink from the communication hole 35A into the ink reservoir 31A is directed vertically downward and after passage through the filter 36A, the ink flows along a tapered structure of the throttling portion 38A toward the common ink chamber or along a direction substantially orthogonal to the in-flow of the ink into the ink reservoir 31A.

Without the tapered portion in the ink reservoir 31A, the flow rate of the ink supplied through the communication hole 35A can be increased by means of the throttling portion 38A disposed in the ink reservoir 31A. This provides for the prevention of the dwell of the air bubbles in the ink reservoir 31A. Hence, the ink supplied to the ink reservoir 31A via the communication hole 35A may preferably be delivered to the common ink chamber.

As a matter of course, this embodiment is also adapted for more effective prevention of the dwell of the air bubbles if, similarly to the aforementioned first embodiment, the tapered portion is provided in the ink reservoir 31A.

Other Embodiments

In the foregoing, the description has been made on the first embodiment of the invention but it is to be noted that the ink-jet print head and the ink-jet recording apparatus of the invention are not limited to the above arrangement. FIGS. 9 to 13 are schematic diagrams showing modifications of the flow-path base plate according to other embodiments of the invention.

Figure 9A:
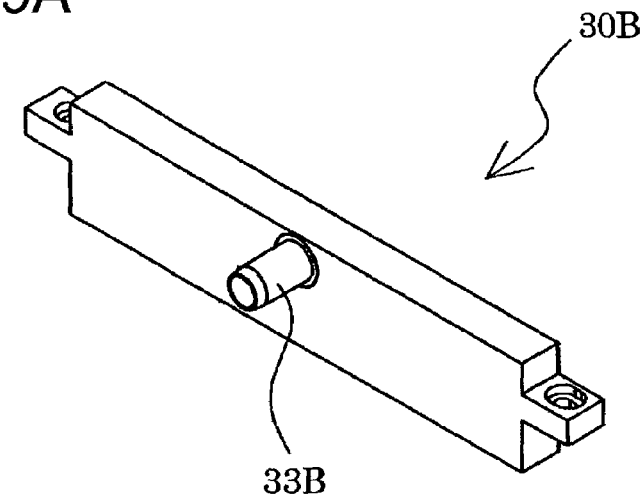
FIG. 9 is a group of schematic diagrams showing a flow-path base plate according to another embodiment of the invention, with FIG. 9A representing a perspective view and FIG. 9B representing a plan view.
Figure 9B:
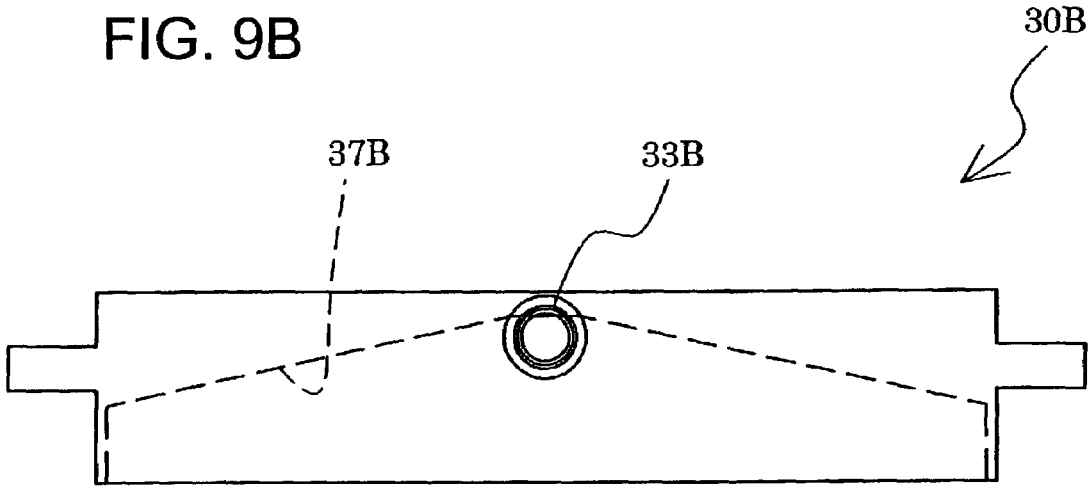
Figure 10A:
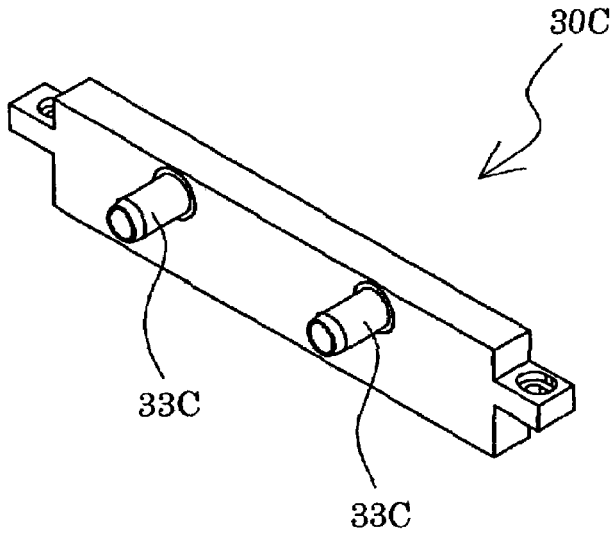
FIG. 10 is a group of schematic diagrams showing a flow-path base plate according to another embodiment of the invention, with FIG. 10A representing a perspective view and FIG. 10B representing a plan view.
Figure 10B:
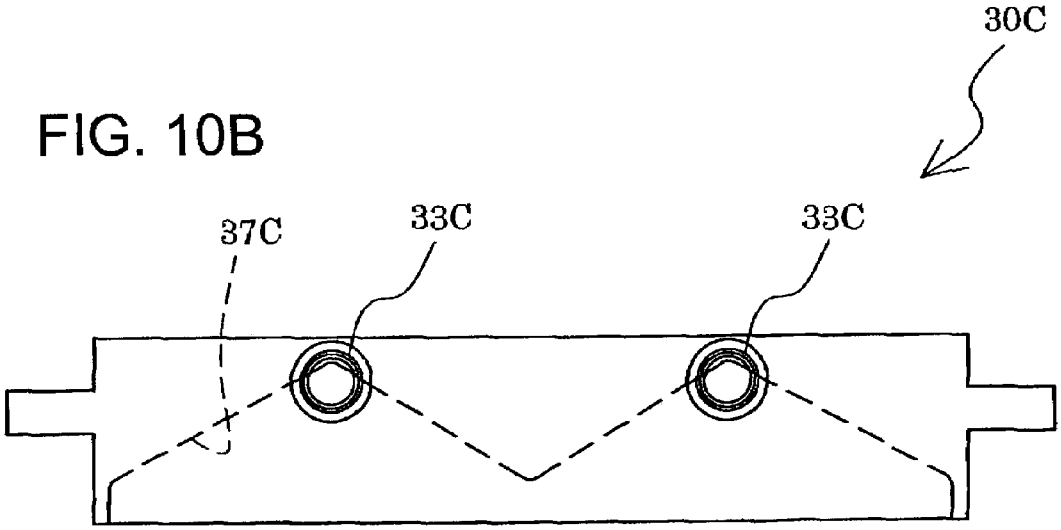

For instance, the first embodiment illustrated the flow-path base plate 30 wherein the communication portions 33 having the ink supply paths 34 are disposed at three places whereas the tapered portions 37 are provided in correspondence to the individual communication portions 33. The invention is not limited to this. As shown in FIGS. 9A–9B, a flow-path base plate 30B may be arranged such that a communication portion 33B is provided at one place and a tapered portion 37B is provided in correspondence thereto. As shown in FIGS. 10A–10B, a flow-path base plate 30C may be arranged such that communication portions 33C are provided at two places and tapered portions 37C are provided in correspondence thereto. Although the illustration is dispensed with, an alternative arrangement may naturally be made such that the flow-path base plate is provided with the communication portions at four or more places and is further provided with the throttling portion in the ink reservoir.

Figure 11A:
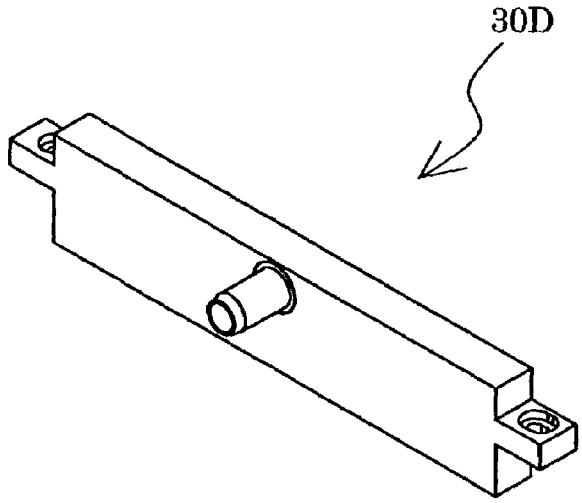
FIG. 11 is a group of schematic diagrams showing a flow-path base plate according to another embodiment of the invention, with FIG. 11A representing a perspective view and FIG. 11B representing a sectional view.
Figure 11B:
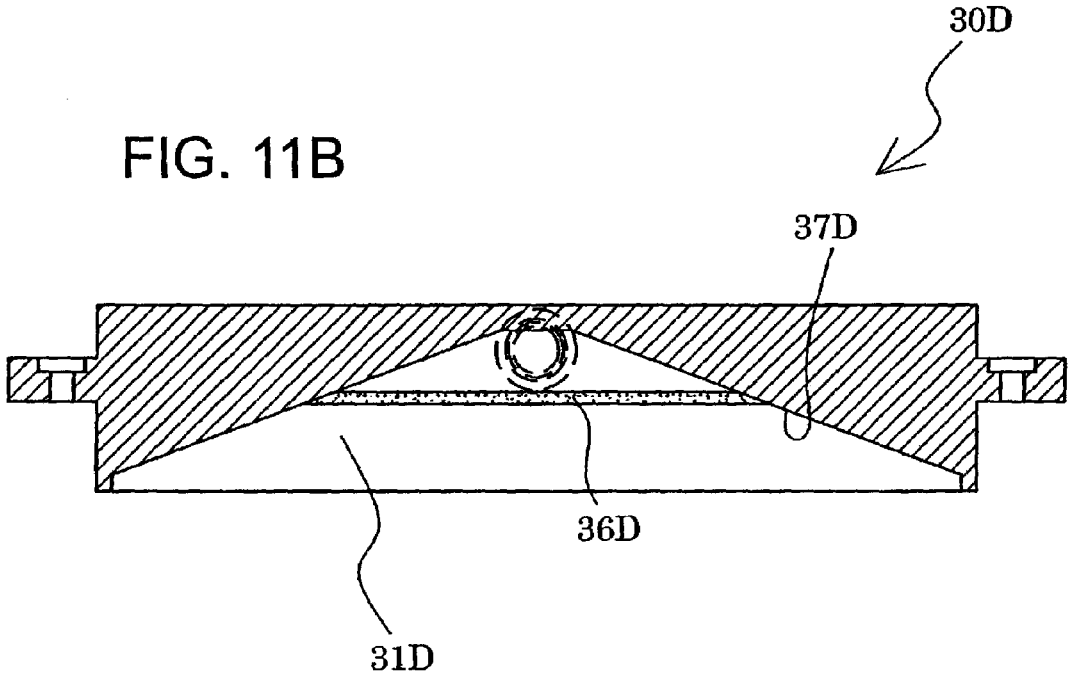
Figure 12A:
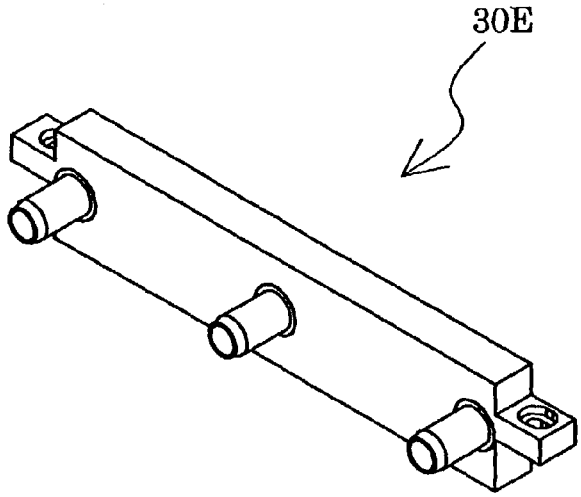
FIG. 12 is a group of schematic diagrams showing a flow-path base plate according to another embodiment of the invention, with FIG. 12A representing a perspective view and FIG. 12B representing a sectional view.
Figure 12B:
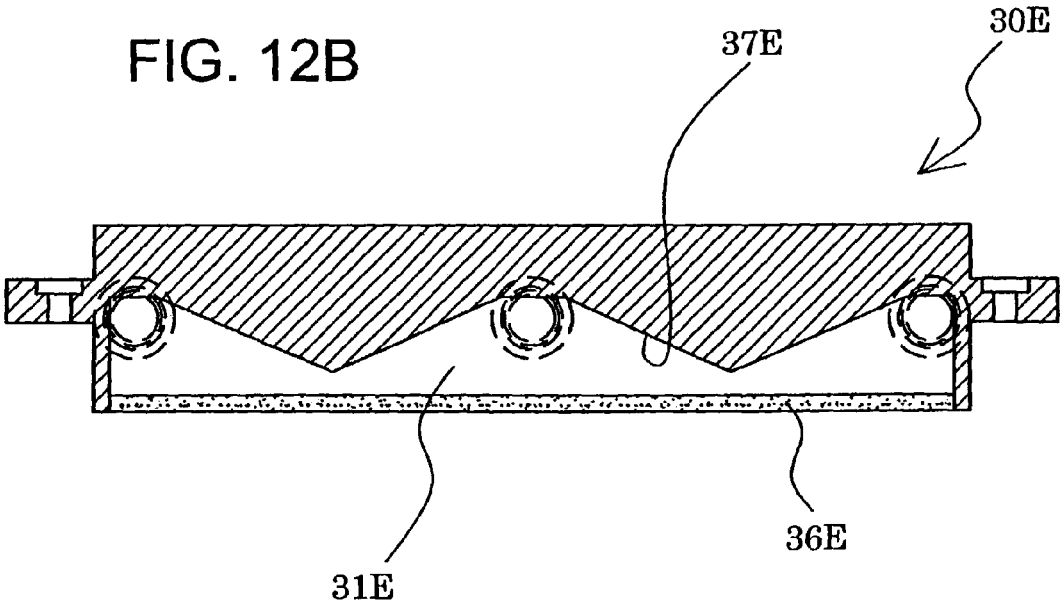

The aforementioned first embodiment has illustrated the flow-path base plate 30 wherein the filter 36 is disposed at such a position as to divide the ink reservoir 31 into halves or at a boundary between the tapered portion 37 and the throttling portion 38. However, the invention is not limited to this. As shown in FIGS. 11A–11B, a flow-path base plate 30D may have an arrangement wherein a filter 36D is disposed intermediate the tapered portion 37D of the ink reservoir 31D. Of course a flow-path base plate 30E may have an arrangement wherein, as shown in FIGS. 12A–12B, a filter 36E is disposed on a side to which tapered portions 37E of the ink reservoir 31E open.

Although an illustration is dispensed with, an alternative arrangement may be made such that filters are disposed intermediate tapered portions, respectively. In this case, the throttling portion may be provided at place closer to the common ink chamber than to the filters.

Figure 13A:
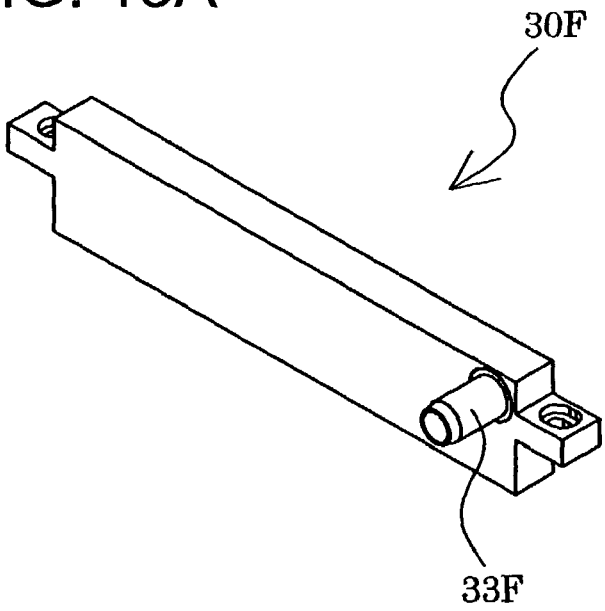
FIG. 13 is a group of schematic diagrams showing a flow-path base plate according to another embodiment of the invention, with FIG. 13A representing a perspective view and FIG. 13B representing a sectional view.
Figure 13B:
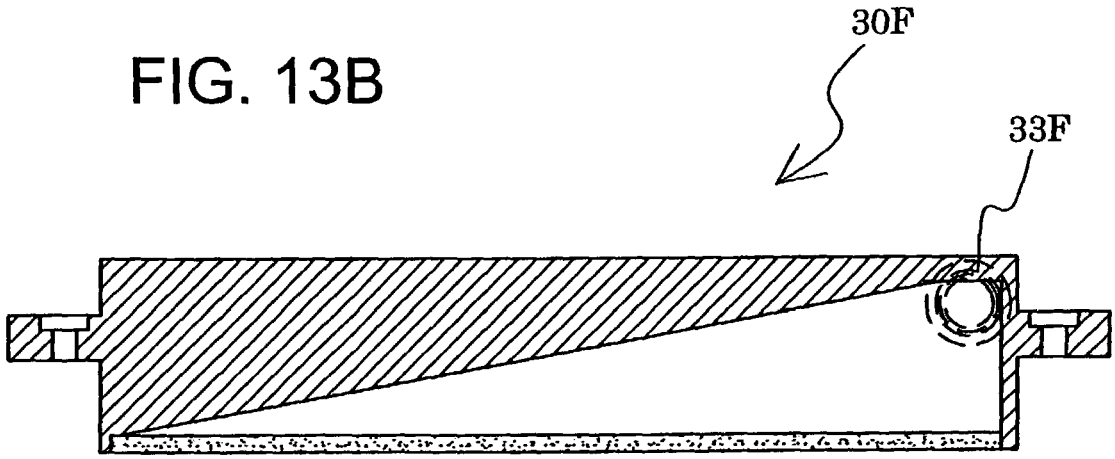
Figure 14:
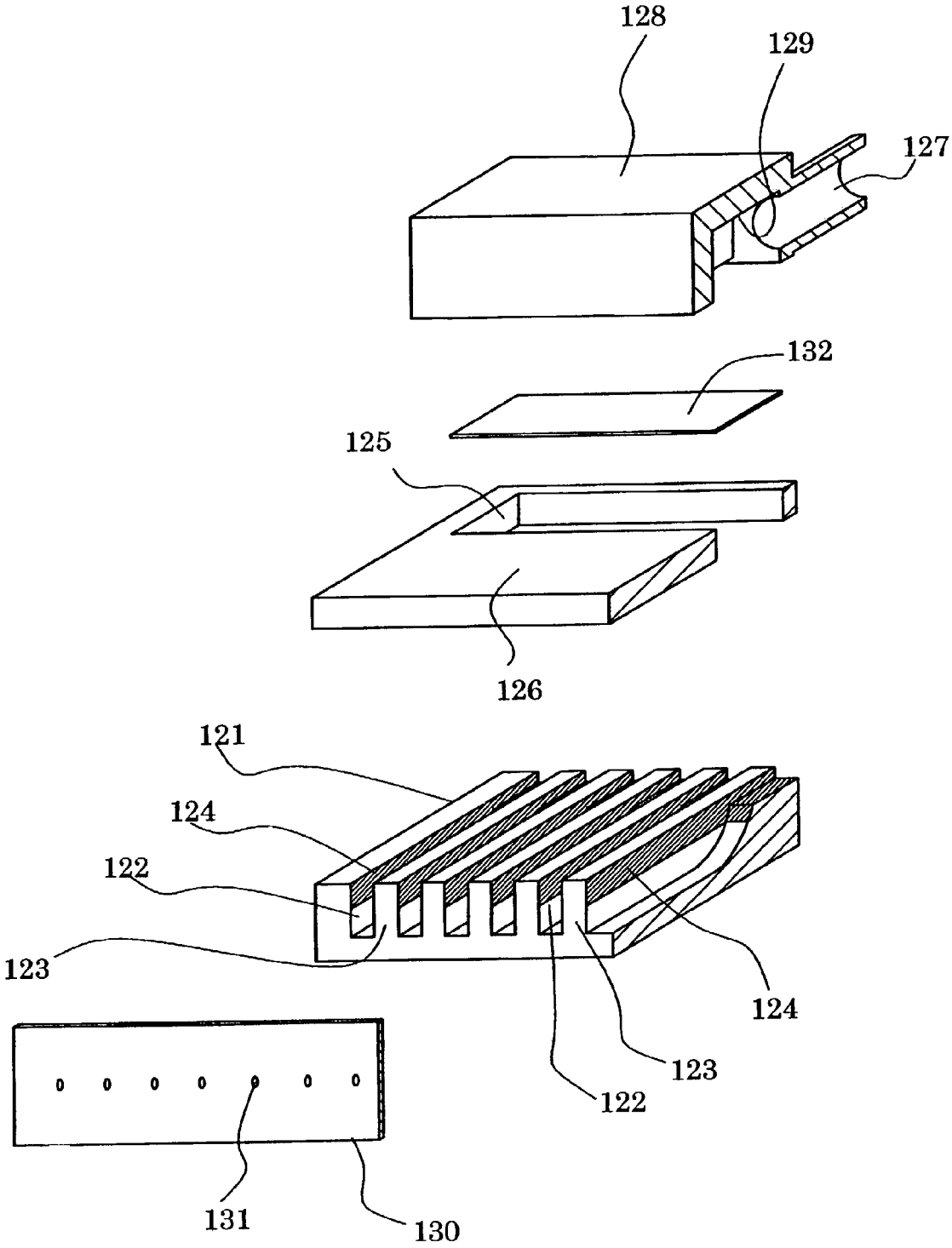
FIG. 14 PRIOR ART
FIG. 14 is an exploded perspective view schematically showing an ink-jet print head according to the prior art.

According to the aforementioned first and second embodiments, the communication portion 33 is provided at least at the central portion of the flow-path base plate 30, 30A. However the invention is not limited to this. As shown in FIGS. 13A–13B, a communication portion 33F may be disposed at a longitudinal end of a flow-path base plate 30F.

According to the aforementioned first and second embodiments, the throttling portion 38, 38A, as a separate member, is provided in the ink reservoir 31, 31A. However, the invention is not limited to these. The flow path body and the throttling portion may be formed in one piece.

In any case, at least one of the tapered portion opened progressively wider toward the ink chamber and the throttling portion progressively narrowing the flow path toward the ink chamber need be provided in the ink reservoir according to the invention.

The filter may be disposed at any place in the flow path extended between the air damper and the common ink chamber. Of course, the filter may be disposed at a place where the tapered portion or the throttling portion is provided. The thickness, size, type and the like of the filter may suitably be selected according to necessities.

The invention is highly effective for use with ink of poor penetration or prone to form air bubbles. It is also understood that the invention is also applicable inks of other types.

Although the invention is particularly useful in a large ink-jet print head ejecting a great quantity of ink, the invention is naturally applicable to a small ink-jet print head, as well.

Although the embodiment of the invention has illustrated the serial type ink-jet recording apparatus, the invention is not limited to this. The invention is also applicable to, for example, a so-called line type ink-jet recording apparatus wherein the ink-jet print head is fixed to place. In this case, the ink-jet print head includes no air damper or the like because the ink is directly supplied from the ink tank. Where mounted to the line type ink-jet recording apparatus, the invention can achieve the same effects as the aforementioned first and second embodiments.

As described above, the invention can prevent the air bubbles contained in the ink from remaining in the ink reservoir or ink chamber because at least one tapered portion opened progressively wider toward the ink chamber and a throttling portion progressively narrowing the flowpath toward the ink chamber is provided in the ink reservoir. Furthermore, the invention permits the cleaning operation to remove the air bubbles via the nozzle apertures in a relatively easy manner.

What is claimed is:

1. An ink-jet print head comprising:

ink storing means for storing ink;

means defining a plurality of grooves formed in a piezoelectric ceramic plate;

means defining an ink chamber formed in an ink chamber plate bonded to the piezoelectric ceramic plate for supplying ink stored in the ink storing means to the grooves; and means defining an ink reservoir formed in a flow-path base plate bonded to a side of the ink chamber plate and forming a portion of an ink flow path intercommunicating the ink storing means with the ink chamber, the ink reservoir having at least one tapered portion progressively diverging in a direction toward the ink chamber.

2. An ink-jet print head according to claim 1; further comprising a filter disposed in the ink reservoir at a position proximate a boundary between the ink reservoir and the ink chamber.

3. An ink-jet print head according to claim 1; wherein the at least one tapered portion of the ink reservoir comprises a first tapered portion and a second tapered portion; and further comprising a filter disposed between the first and second tapered portions of the ink reservoir.

4. An ink-jet print head according to claim 3; wherein the first tapered portion diverges progressively toward the filter; and wherein the filter covers openings of the first tapered portion.

5. An ink-jet print head according to claim 1; wherein the ink reservoir has a communication hole communicating with the ink flow path; and wherein the tapered portion progressively diverges from the communication hole in a direction toward the ink chamber.

6. An ink-jet print head according to claim 1; wherein the ink reservoir has a plurality of communication holes communicating with the ink flow path; and wherein the at least one tapered portion comprises a plurality of tapered portions each progressively diverging from a respective one of the communication holes in a direction toward the ink chamber.

7. An ink-jet print head according to claim 1; wherein the ink reservoir has a communication hole for directing ink from the ink storing means to the ink reservoir in first direction; and wherein the portion of the ink flow path formed by the ink reservoir directs ink from the ink reservoir toward the ink chamber in a direction generally orthogonal to the first direction.

8. An ink-jet print head according to claim 7; wherein the at least one tapered portion of the ink reservoir comprises a first tapered portion and a second tapered portion; and further comprising a filter disposed between the first and second tapered portions of the ink reservoir and a throttling portion disposed in the second tapered portion of the ink reservoir for progressively converging a portion of the ink flow path from the filter toward the ink chamber.

9. An ink-jet print head according to 8; wherein the throttling portion has a tapered surface progressively converging the portion of the ink flow path from the filter toward the ink chamber.

10. An ink-jet recording apparatus having the ink-jet print head according to claim 1.

11. An ink-jet print head comprising:

a piezoelectric ceramic plate having a plurality of grooves each for receiving ink;

a nozzle plate connected to the piezoelectric ceramic plate and having a plurality of nozzle apertures each disposed in communication with respective ones of the grooves;

ink storing means for storing ink;

an ink chamber plate connected to the piezoelectric ceramic plate and having an ink chamber for supplying ink from the ink storing means to the grooves; and a base plate connected to a side of the ink chamber plate and having an ink reservoir defining a portion of an ink flow path for transporting ink from the ink storing means to the ink chamber of the ink chamber plate, the ink reservoir having at least one tapered portion progressively diverging in a direction toward the ink chamber of the ink chamber plate.

12. An ink-jet print head according to claim 11; further comprising a filter disposed in the ink reservoir at a position proximate a boundary between the ink reservoir and the ink chamber.

13. An ink-jet print head according to claim 11; wherein the at least one tapered portion of the ink reservoir comprises a first tapered portion and a second tapered portion; and further comprising a filter disposed between the first and second tapered portions of the ink reservoir.

14. An ink-jet print head according to claim 11; wherein the ink reservoir has a communication hole communicating with the ink flow path; and wherein the tapered portion progressively diverges from the communication hole in a direction toward the ink chamber.

15. An ink-jet print head according to claim 11; wherein the ink reservoir has a plurality of communication holes communicating with the ink flow path; and wherein the at least one tapered portion comprises a plurality of tapered portions each progressively diverging from a respective one of the communication holes in a direction toward the ink chamber.

16. An ink-jet print head according to claim 11; wherein the ink reservoir has a communication hole for directing ink from the ink storing means to the ink reservoir in first direction; and wherein the portion of the ink flow path defined by the ink reservoir transports ink from the ink reservoir toward the ink chamber in a direction generally orthogonal to the first direction.

17. An ink-jet print head according to claim 16; wherein the at least one tapered portion of the ink reservoir comprises a first tapered portion and a second tapered portion; and further comprising a filter disposed between the first and second tapered portions of the ink reservoir and a throttling portion disposed in the second tapered portion of the ink reservoir for progressively converging a portion of the ink flow path from the filter toward the ink chamber.

18. An ink-jet print head according to claim 17; wherein the throttling portion has a tapered surface progressively converging the portion of the ink flow path from the filter toward the ink chamber.

19. An ink-jet recording apparatus having the ink-jet print head according to claim 11.

20. An ink-jet print head comprising:

ink storing means for storing ink;

means defining a plurality of grooves formed in a piezoelectric ceramic plate;

means defining an ink chamber formed in an ink chamber plate bonded to the piezoelectric ceramic plate for supplying ink stored in the ink storing means to the grooves;

means defining an ink reservoir formed in a base plate bonded to a side of the ink chamber plate and forming a portion of an ink flow path for transporting ink from the ink storing means to the ink chamber of the ink chamber plate; and a filter for filtering ink transported from the ink storing means to the ink chamber of the ink chamber plate, the filter being disposed in the ink reservoir to divide the ink flow path into a first ink flow path portion progressively diverging toward the ink chamber and a second ink flow path portion disposed closer to the ink chamber than the first portion.

21. An ink-jet print head according to claim 20; further comprising a throttling portion disposed in the second ink flow path portion for progressively converging the second ink flow path portion toward the ink chamber.

* * * * *